US007775182B2

(12) United States Patent
Shindo et al.

(10) Patent No.: US 7,775,182 B2
(45) Date of Patent: Aug. 17, 2010

(54) BOILER

(75) Inventors: Takashi Shindo, Matsuyama (JP); Kenichi Shinomori, Matsuyama (JP)

(73) Assignee: Miura Co., Ltd, Ehime-ken (JP)

( * ) Notice: Subject to any disclaimer, the term of this patent is extended or adjusted under 35 U.S.C. 154(b) by 263 days.

(21) Appl. No.: 11/920,925

(22) PCT Filed: Jun. 30, 2006

(86) PCT No.: PCT/JP2006/313065

§ 371 (c)(1),
(2), (4) Date: Nov. 21, 2007

(87) PCT Pub. No.: WO2007/004539

PCT Pub. Date: Jan. 11, 2007

(65) Prior Publication Data

US 2009/0133644 A1 May 28, 2009

(30) Foreign Application Priority Data

Jul. 4, 2005 (JP) ..... 2005-195472
Oct. 28, 2005 (JP) ..... 2005-315237

(51) Int. Cl.
*F22B 25/00* (2006.01)

(52) U.S. Cl. ..... 122/235.11; 122/6 A

(58) Field of Classification Search ..... 122/6 A, 122/1 B, 114, 235.11, 235.23; 431/181, 431/182, 183, 184

See application file for complete search history.

(56) References Cited

U.S. PATENT DOCUMENTS 2,298,857 A * 10/1942 Clark ..... 110/323
3,633,550 A * 1/1972 Kraus ..... 122/235.11
4,201,538 A * 5/1980 Kopp ..... 431/351
4,257,358 A * 3/1981 Watanabe ..... 122/235.11
4,453,496 A * 6/1984 Yoshinari ..... 122/6 A
4,471,725 A * 9/1984 Holden ..... 122/379
5,199,384 A * 4/1993 Kayahara et al. ..... 122/18.4
5,257,927 A * 11/1993 Lang ..... 431/184
5,273,001 A * 12/1993 Kayahara et al. ..... 122/138
6,116,196 A * 9/2000 Watanabe et al. ..... 122/235.11
6,318,305 B1 * 11/2001 Takubo et al. ..... 122/235.11
6,347,935 B1 * 2/2002 Schindler et al. ..... 431/5
6,823,821 B2 * 11/2004 Kayahara et al. ..... 122/367.1

FOREIGN PATENT DOCUMENTS

JP 6-193824 A 7/1994
JP 8-061614 A 3/1996
JP 2004-177022 A 6/2004
JP 2005-16781 A 1/2005

* cited by examiner

*Primary Examiner*—Gregory A Wilson
(74) *Attorney, Agent, or Firm*—Birch, Stewart, Kolasch & Birch, LLP

(57) ABSTRACT

Provided is a boiler equipped with a burner capable of realizing a reduction in emission of harmful substances using a liquid fuel such as kerosene or A-type heavy oil. A burner (20) is equipped with a nozzle part (22) spraying a liquid fuel into a combustion chamber (16) in a boiler body (10) formed by using a plurality of water tubes; provided around the nozzle part (22) is an air jetting part (27) constructed to control flow of air jetted from the air jetting part (27) so as to avoid short-passing of a gas produced by the burner (20) through a gas discharge port provided in the boiler body (10).

20 Claims, 9 Drawing Sheets

BOILER

BACKGROUND OF THE INVENTION

1. Field of the Invention

The present invention relates to a boiler. More specifically, the present invention relates to a boiler that can realize a reduction in emission of harmful substances by using a liquid fuel such as kerosene or A-type heavy oil.

2. Description of the Related Art

A boiler equipped with a boiler body having a group of water tubes arranged in an annular fashion has conventionally been well known. Generally speaking, in such a boiler, a burner is arranged at the center of the group of water tubes. That is, in a boiler of this construction, the central portion of the group of water tubes arranged in an annular fashion functions as a combustion chamber for burning the fuel supplied from the burner.

In connection with a case in which a gas fuel is used as a burner fuel, a number of proposals have been made regarding a technology for achieving an improvement in combustion property and a technology for reducing the generation of harmful substances (such as NOx, CO, and soot) (see, for example, JP 08-61614 A), and some of those proposals have proved effective.

However, despite the various proposals made up to now, regarding the boiler equipped with a combustion device using a liquid fuel such as kerosene or A-type heavy oil, the technology for achieving an improvement in combustion property and the technology for reducing the generation of harmful substances (such as NOx, CO, and soot) have made less progress than those for combustion devices using a gas fuel.

Further, in the above-mentioned boiler formed by using a boiler body having a group of water tubes arranged in an annular fashion, depending upon a position of a gas discharge port provided in the boiler body, the gas produced by the burner tends to be drawn in a specific direction (mainly in a direction in which the gas discharge port is provided), which may adversely affect the combustion performance of the burner.

SUMMARY OF THE INVENTION

The present invention has been made with a view toward solving the above-mentioned problems in the prior art. It is accordingly an object of the present invention to provide a burner that can realize a reduction in the emission of harmful substances by using a liquid fuel such as kerosene or A-type heavy oil. An other object of the present invention is to provide a boiler that can realize a reduction in such harmful substances.

The present invention has been made to achieve the above-mentioned objects, and there is provided a burner including a nozzle part for spraying a liquid fuel into a combustion chamber in a boiler body formed by using a plurality of water tubes, and an air jetting part provided around the nozzle part, in which the air jetting part is constructed to control a flow of air jetted from the air jetting part so as to prevent short-passing of a gas produced by the burner through a gas discharge port provided in the boiler body.

Further, in the burner of the present invention, it is desirable that the air jetting part have a guide portion for guiding at least a part of the air jetted from the air jetting part away from the gas discharge port, and a diffusing portion for promoting diffusion of the air jetted from the air jetting part.

Further, in the burner of the present invention, it is desirable that a plurality of air jetting parts be provided around the nozzle part and that at least one of the air jetting parts have a guide portion for guiding at least a part of the air jetted from the air jetting parts away from the gas discharge port and a diffusing portion for promoting diffusion of the air jetted from the air jetting parts.

Further, in the burner of the present invention, it is desirable that a plurality of air jetting parts be provided around the nozzle part and that at least one of the air jetting parts situated on the side of the gas discharge port provided in the boiler body have a guide portion for guiding at least a part of the air jetted from the air jetting parts away from the gas discharge port and a diffusing portion for promoting diffusion of the air jetted from the air jetting parts.

Further, in the burner of the present invention, it is desirable that a plurality of air jetting parts be provided around the nozzle part and that at least one of the air jetting parts situated on a side of the gas discharge port provided in the boiler body have a guide portion for guiding at least a part of the air jetted from the air jetting parts away from the gas discharge port and a diffusing portion for promoting diffusion of the air jetted from the air jetting parts, with the air jetting parts situated on the side opposite to the gas discharge port being provided with no guide portions.

Further, in the burner of the present invention, it is desirable that six air jetting parts be provided uniformly (at an interval of 60 degrees) around the nozzle part, and that three of the air jetting parts situated on the side of (in close proximity to) the gas discharge port provided in the boiler body have guide portions for guiding at least a part of the air jetted from the air jetting parts away from the gas discharge port and diffusing portions for promoting diffusion of the air jetted from the air jetting parts.

Further, in the burner of the present invention, it is desirable that the guide portion be formed by using a plate-like member provided on a side of the gas discharge port of the air jetting part, and that the plate-like member be inclined so that the plate-like member guides at least a part of the air jetted from the air jetting part away from the gas discharge port.

Further, in the burner of the present invention, it is desirable that a height of the guide portion be set so that the guide portion is prevented from coming into contact with the liquid fuel sprayed from the nozzle part.

Further, the present invention has been made to achieve the above-mentioned objects, and there is provided a boiler including: a boiler body formed by using a plurality of water tubes; a burner having a nozzle part for spraying a liquid fuel into a combustion chamber in the boiler body; and an air jetting part provided around the nozzle part, in which the air jetting part is constructed to control a flow of air jetted from the air jetting part so as to prevent short-passing of a gas produced by the burner through a gas discharge port provided in the boiler body.

Further, in the boiler of the present invention, it is desirable that the air jetting part have a guide portion for guiding at least a part of the air jetted from the air jetting part away from the gas discharge port, and a diffusing portion for promoting diffusion of the air jetted from the air jetting part.

Further, the present invention relates to a boiler including: a boiler body formed by using a plurality of water tubes; a burner having a nozzle part for spraying a liquid fuel into a combustion chamber in the boiler body; and an air jetting part provided around the nozzle part, in which the air jetting part has a guide portion for guiding at least a part of air jetted from the air jetting part away from a gas discharge port, and a diffusing portion for promoting diffusion of the air jetted from the air jetting part.

Further, in the boiler of the present invention, it is desirable that the guide portion be formed by using a plate-like member provided on a side of the gas discharge port of the air jetting part, and that the plate-like member be inclined so that the plate-like member guides at least a part of the air jetted from the air jetting part away from the gas discharge port.

Further, in the boiler of the present invention, it is desirable that a height of the guide portion be set so that the guide portion is prevented from coming into contact with the liquid fuel sprayed from the nozzle part.

Further, in the boiler of the present invention, it is desirable that the gas discharge port provided in the boiler body be open along longitudinal axes of the water tubes.

According to the present invention, it is possible to provide a burner capable of realizing a reduction in the emission of harmful substances using a liquid fuel such as kerosene or A-type heavy oil. Further, according to the present invention, it is possible to provide a boiler capable of realizing a reduction in the generation harmful substances.

DESCRIPTION OF THE PREFERRED EMBODIMENTS

Figure 1:
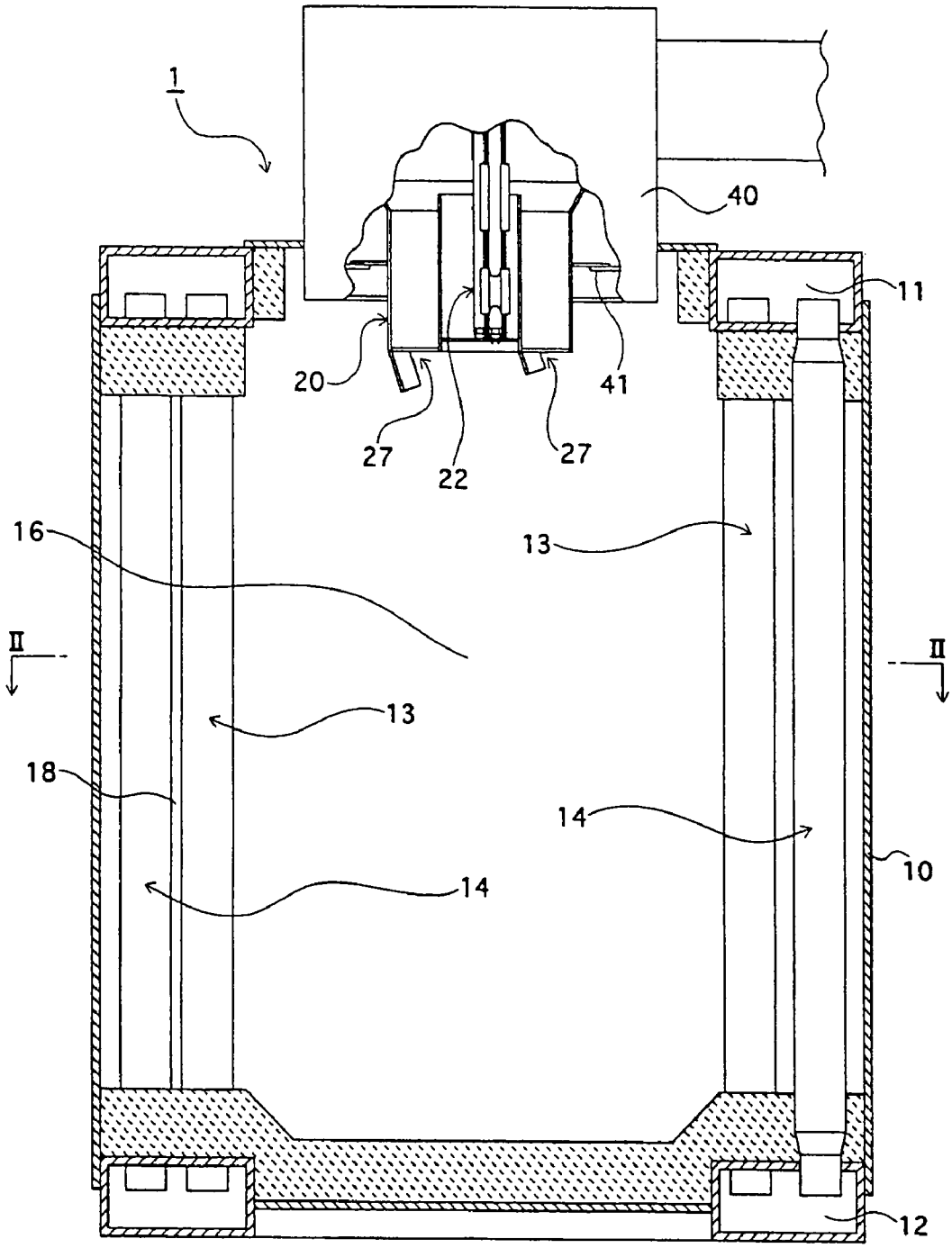
FIG. 1 is an explanatory longitudinal sectional view of a boiler according to an embodiment of the present invention.

Before a description of embodiments of the present invention, some of terms used in this specification will be clarified.

In this specification, a term "gas" implies at least one of the following two concepts: a gas under burning reaction and a gas that has completed burning reaction; it may also be referred to as "combustion gas". That is, unless otherwise specified, the term "gas" covers all of the following three cases: a case in which both the gas under burning reaction and the gas that has completed burning reaction coexist; a case in which only the gas under burning reaction exists; and a case in which only the gas that has completed burning reaction exists.

A term "exhaust gas" implies a gas that has completed or almost completed burning reaction. Further, unless otherwise specified, the term "exhaust gas" implies both or one of the following two concepts: a gas having passed through the boiler body of the boiler and reached a chimney portion, and a gas circulating within the boiler body.

Unless otherwise specified, a term "gas temperature" implies a temperature of the gas under burning reaction; it is synonymous with combustion temperature or combustion flame temperature. An expression: "suppression of gas temperature" implies keeping a maximum value of gas (combustion flame) temperature at a low level. Usually, although in a very small quantity, burning reaction is continued also in the "gas that has completed burning reaction", so the expression: "completion of burning reaction" does not imply 100% completion of burning reaction.

In the following, embodiments of the present invention will be described.

First, a burner according to a first embodiment mode of the present invention is a burner equipped with a nozzle part for spraying a liquid fuel into a combustion chamber of a boiler body formed by using a plurality of water tubes; provided around the nozzle part is an air jetting part constructed to control a flow of air jetted from the air jetting part so as to prevent short-passing of a gas produced by the burner through a gas discharge port provided in the boiler body. In this case, the term "short-passing" means flowing of the gas produced by the burner out of the boiler body through the upper portion of the gas discharge port provided in the boiler body instead of flowing toward the bottom of the combustion chamber in the boiler body.

With this construction, since the air jetting part is constructed so as to prevent short-passing of the gas produced by the burner through the gas discharge port provided in the boiler body, it is possible to improve the combustion performance of the burner and to realize a reduction in the emission of harmful substances.

More specifically, with this construction, the gas is not allowed to short-pass through (be drawn toward) the gas discharge port, so the gas (inclusive of flame) produced at the burner can be expanded to a sufficient degree within the boiler body. That is, due to this expansion of the gas, the gas temperature is lowered, so it is possible to achieve a reduction in NOx value.

Further, since the gas is not drawn to the gas discharge port side, an exhaust gas circulation flow within the boiler body is formed in an appropriate manner. Then, due to the exhaust gas circulation flow (self EGR) within the boiler body, the gas temperature is lowered, and the NOx value can be reduced.

A burner according to a second embodiment mode has a structure in which the above-mentioned air jetting part is constructed to have a guide portion for guiding at least a part of the air jetted from the air jetting part away from the gas discharge port, and a diffusing portion for promoting diffusion of the air jetted from the air jetting part.

With this construction, there is provided not only the guide portion but also the diffusing portion, so, in close proximity to the burner, it is possible to partially make uneven a way the liquid fuel sprayed from the nozzle part and the air are mixed with each other. That is, with this burner, constructed as described above, the mixing state is not simply made satisfactory, but a partially uneven mixing state is attained intentionally by the diffusing portion, whereby it is possible to lower the gas temperature and to reduce the NOx value.

A burner according to a third embodiment mode has a structure in which a plurality of air jetting parts are provided around the nozzle part, and at least one air jetting part has a guide portion for guiding at least a part of the air jetted from the air jetting parts away from the gas discharge port and a diffusing portion for promoting diffusion of the air jetted from the air jetting parts.

A burner according to a fourth embodiment mode has a structure in which a plurality of air jetting parts are provided around the nozzle part, and at least one air jetting part situated on the side of the gas discharge port provided in the boiler body has a guide portion for guiding at least a part of the air jetted from the air jetting parts away from the gas discharge port and a diffusing portion for promoting diffusion of the air jetted from the air jetting parts.

A burner according to a fifth embodiment mode has a structure in which a plurality of air jetting parts are provided around the nozzle part, and at least one air jetting part situated on the side of the gas discharge port provided in the boiler body has a guide portion for guiding at least a part of the air jetted from the air jetting parts away from the gas discharge port and a diffusing portion for promoting diffusion of the air jetted from the air jetting parts, with the air jetting parts situated on the side opposite to the gas discharge port being provided with no guide portions.

A burner according to a sixth embodiment mode has a structure in which six air jetting parts are provided uniformly around the nozzle part (at an interval of 60 degrees), and three air jetting parts situated on the side of (in close proximity to) the gas discharge port provided in the boiler body have a guide portion for guiding at least a part of the air jetted from the air jetting parts away from the gas discharge port and a diffusing portion for promoting diffusion of the air jetted from the air jetting parts.

A burner according to a seventh embodiment mode has a structure in which the guide portion is formed by using a plate-like member provided on the gas discharge port side of the air jetting part, with the plate-like member being inclined so as to guide at least a part of the air jetted from the air jetting part away from the gas discharge port. That is, in the burner of this construction, a guide portion formed of a plate-like member is provided in order to partly shield between the air jetting part and the gas discharge port, with the plate-like member being provided so as to be inclined to the side opposite to the gas discharge port.

With this construction, the guide portion can be formed relatively easily. Further, by adjusting the size, the mounting position, etc. of this plate-like member, not only the guide portion but also the above-mentioned diffusing portion can be formed in a simple construction. That is, it is possible to cause the portion provided with the plate-like member to function as the guide portion, and to cause the part of the air jetting part provided with no guide portion to function as the diffusing portion.

A burner according to an eighth embodiment mode has a structure in which the height of the guide portion is set so as to avoid contact with the liquid fuel sprayed from the nozzle part.

With this construction, the liquid fuel does not come into contact with the guide portion, so inappropriate incomplete combustion in the immediate vicinity of the burner is eliminated, making it possible to effectively prevent generation of CO and sooty dust.

Next, a boiler according to a ninth embodiment mode is a boiler equipped with a boiler body formed by using a plurality of water tubes, and a burner having a nozzle part for spraying a liquid fuel into a combustion chamber in the boiler body; provided around the nozzle part is an air jetting part, which is constructed to control the flow of air jetted from the air jetting part so as to prevent short-passing of the gas produced by the burner through a gas discharge port provided in the boiler body.

With this construction, since there is provided an air control portion to prevent short-passing of the gas produced by the burner through the gas discharge port provided in the boiler body, it is possible to improve the combustion performance of the burner and to obtain a boiler capable of realizing a reduction in the emission of harmful substances.

A boiler according to a tenth embodiment mode has a structure in which the air jetting part has a guide portion for guiding at least a part of the air jetted from the air jetting part away from the gas discharge port, and a diffusing portion for promoting diffusion of the air jetted from the air jetting part.

With this construction, since the burner has the diffusing portion, in the immediate vicinity of the burner, it is possible to make partially uneven the mixing condition of the liquid fuel sprayed from the nozzle part and the air. That is, the burner of this construction does not simply make the mixing condition satisfactory, but also intentionally attains a partially uneven mixing condition by the diffusing portion, so the boiler constructed by using this burner makes it possible to lower the gas temperature in the boiler body and to achieve a reduction in NOx value.

A boiler according to an eleventh embodiment mode is a boiler equipped with a boiler body formed by using a plurality of water tubes, and a burner having a nozzle part for spraying a liquid fuel into a combustion chamber in the boiler body; provided around the nozzle part is an air jetting part, which has a guide portion for guiding at least a part of the air jetted from the air jetting part away from a gas discharge port and a diffusing portion for promoting diffusion of the air jetted from the air jetting part.

A boiler according to a twelfth embodiment mode has a structure in which the guide portion constituting the burner is formed by using a plate-like member provided on the gas discharge port side of the air jetting part, with the plate-like member being inclined so as to guide at least a part of the air jetted from the air jetting part away from the gas discharge port.

A boiler according to a thirteenth embodiment mode has a structure in which the height of the guide portion is set so as to avoid contact with the liquid fuel sprayed from the nozzle part constituting the burner.

A boiler according to a fourteenth embodiment has a structure in which the gas discharge port provided in the boiler body is open along the longitudinal axes of the water tubes.

In the following, a burner and a boiler according to an embodiment of the present invention will be described with reference to the drawings.

Figure 2:
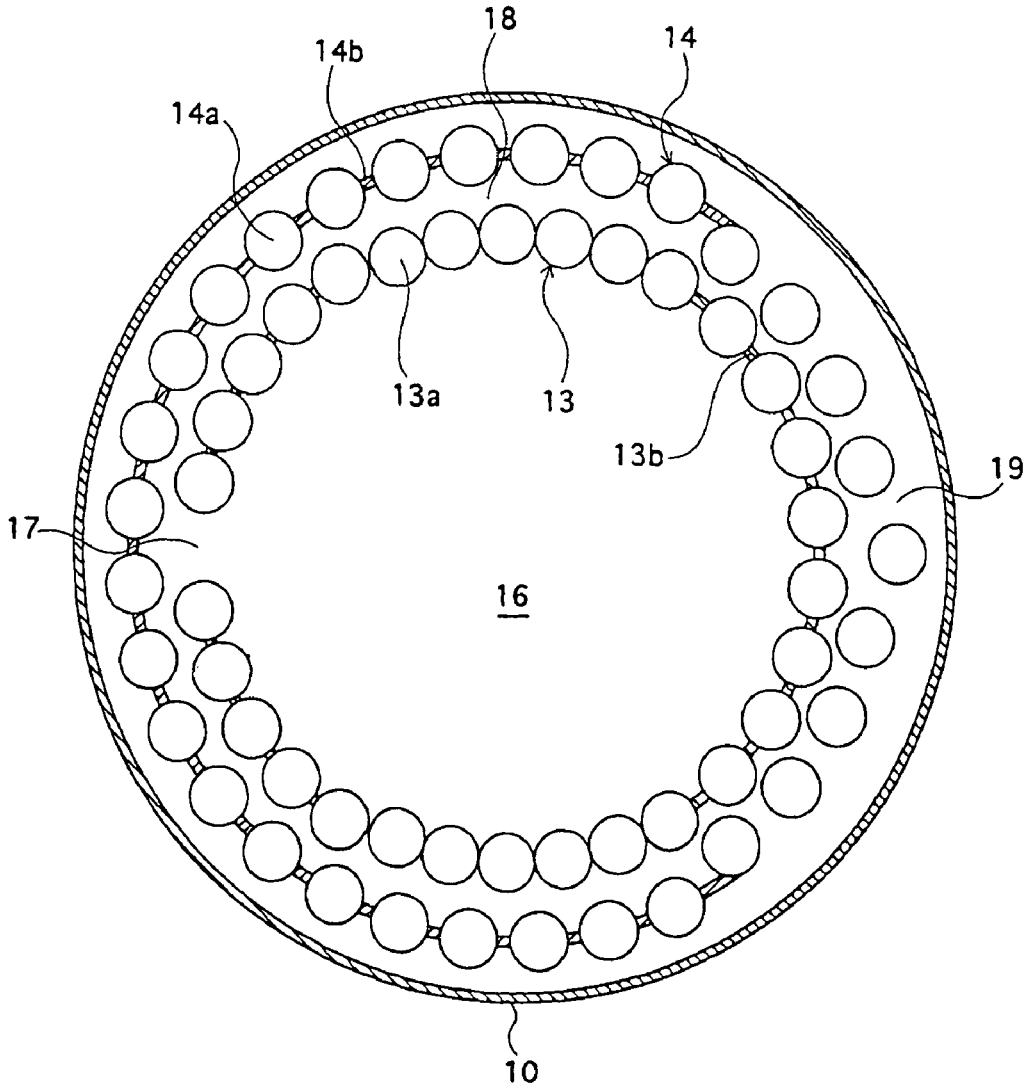
FIG. 2 is an explanatory cross-sectional view taken along the line II-II of FIG. 1.
Figure 3:
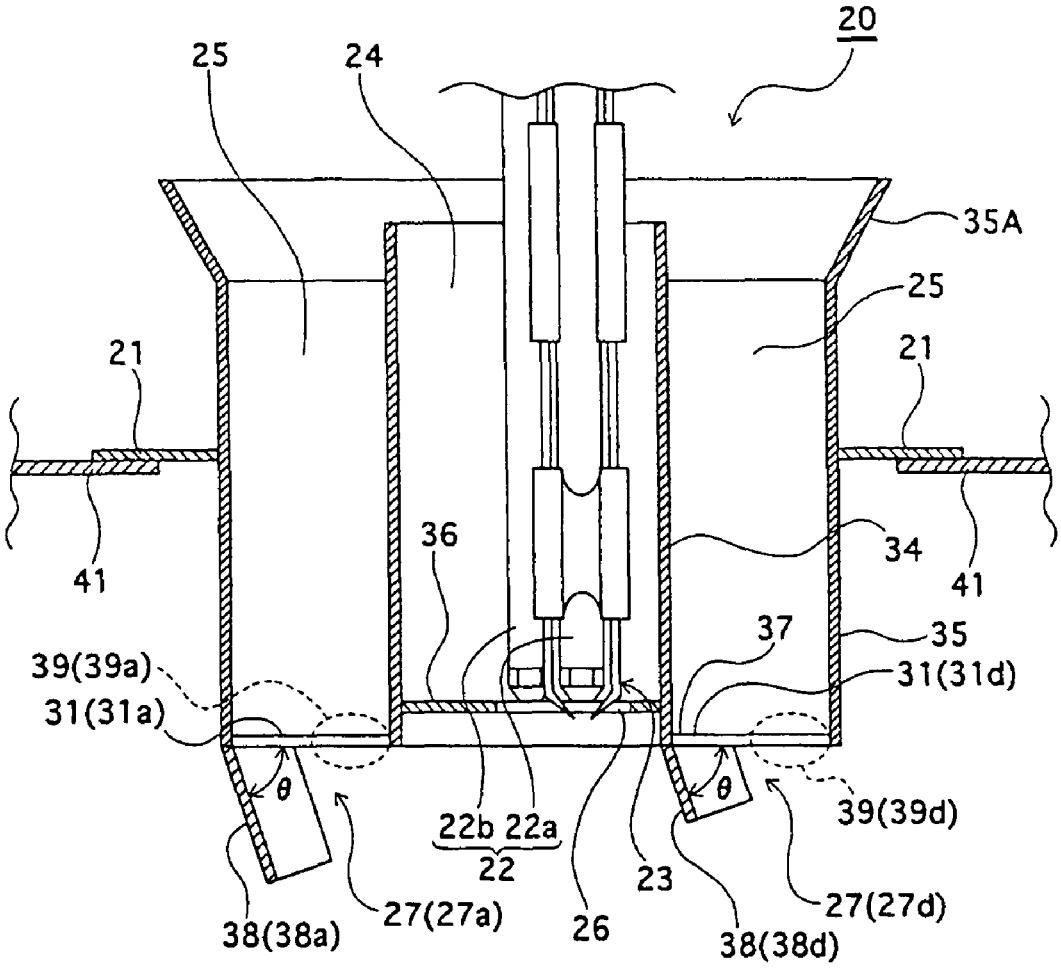
FIG. 3 is an explanatory longitudinal sectional view of a burner according to the embodiment of the present invention.
Figure 4:
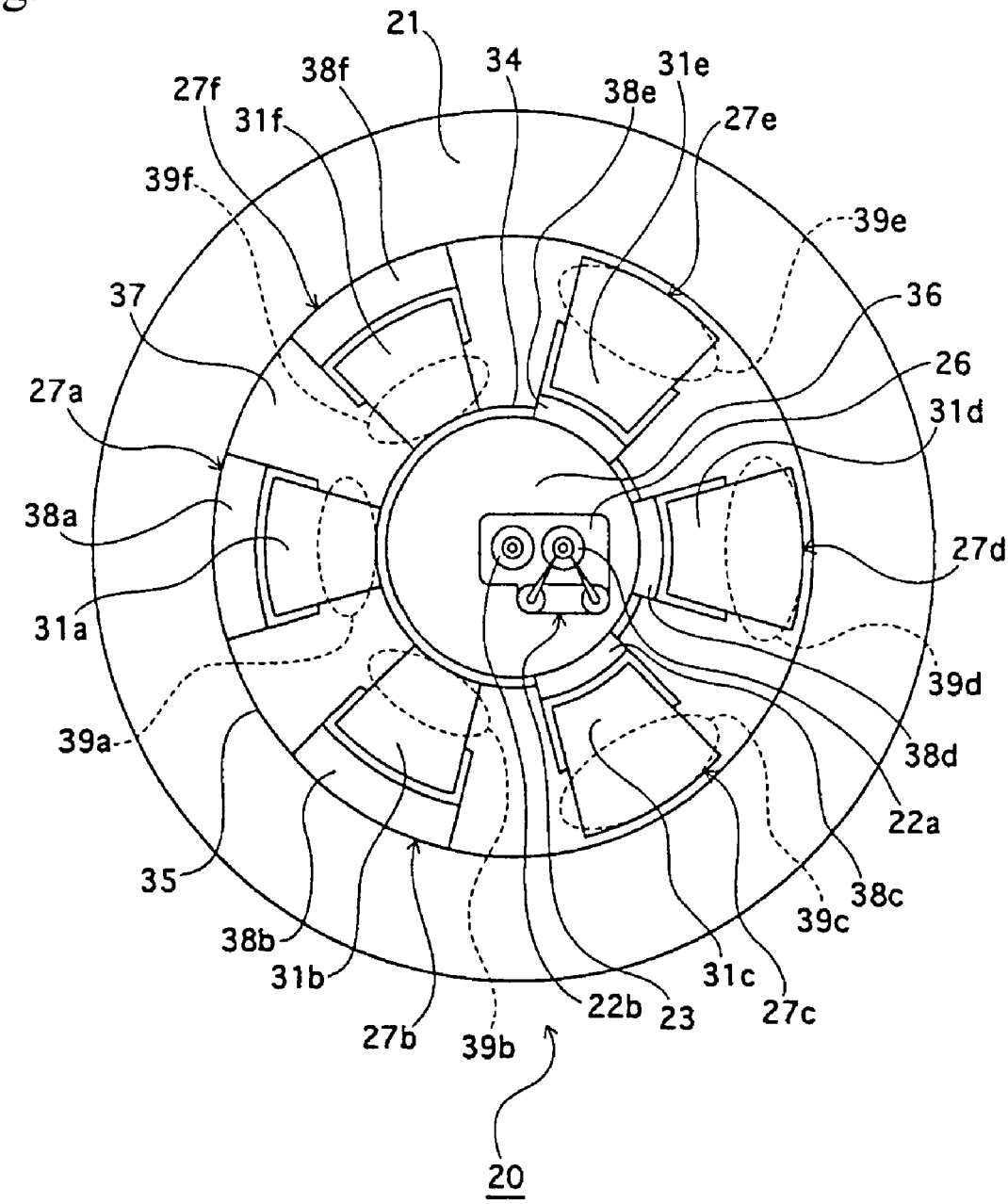
FIG. 4 is a bottom view of the burner shown in FIG. 3.
Figure 5:
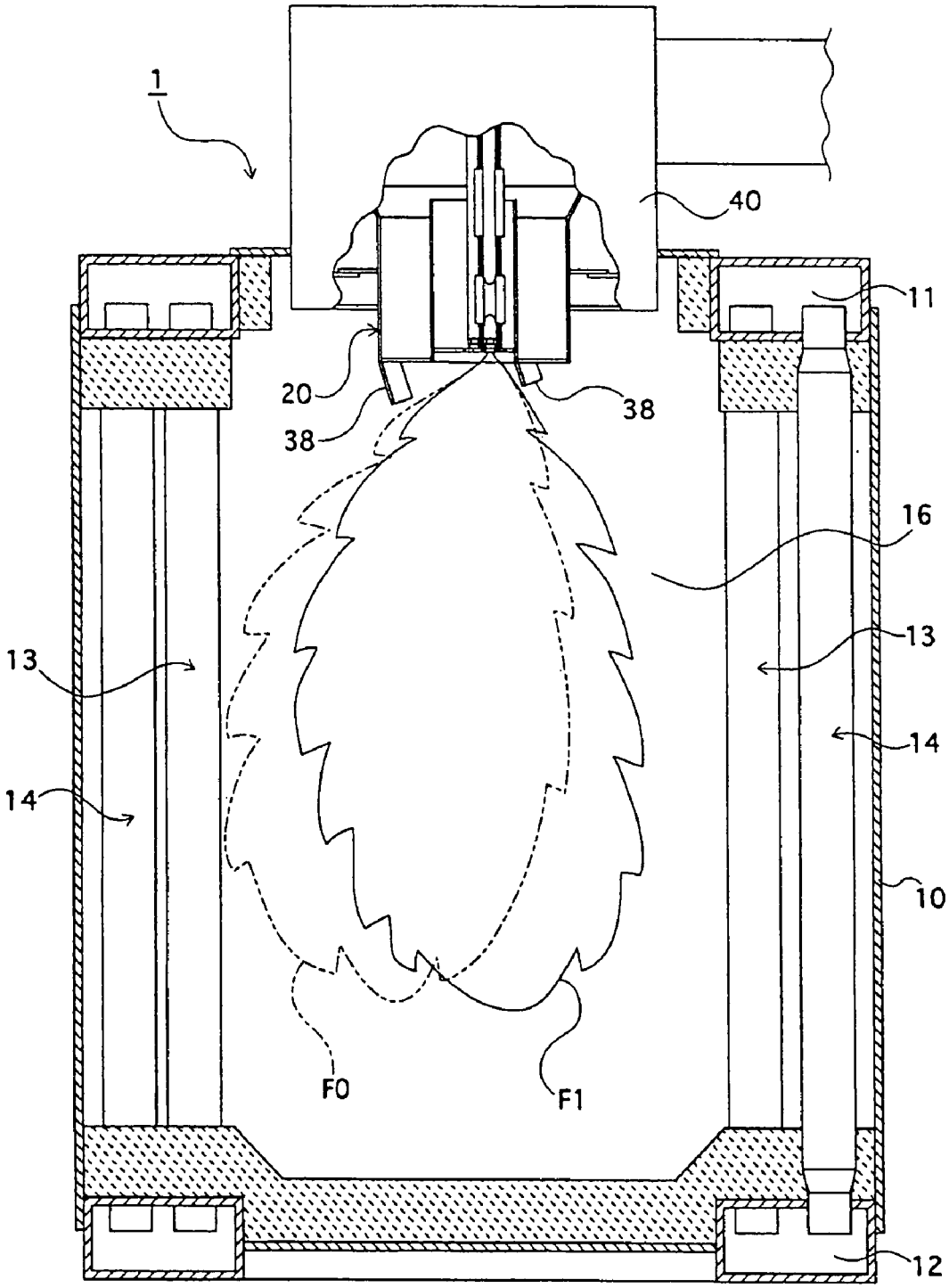
FIG. 5 is a schematic diagram illustrating a gas flow at a time of low combustion.

FIG. 1 is a schematic view of a boiler according to an embodiment of the present invention. In this case, FIG. 1 is an explanatory longitudinal sectional view of the boiler of this embodiment. FIG. 2 is an explanatory cross-sectional view taken along the line II-II of FIG. 1. FIGS. 3 and 4 are schematic views of a burner provided in the boiler of this embodiment. In this case, FIG. 3 is an explanatory longitudinal sectional view of the burner of this embodiment, and FIG. 4 is a bottom view of the burner shown in FIG. 3. FIG. 5 is a schematic view illustrating the burning condition (gas flow) in the boiler of this embodiment.

As shown in FIGS. 1 and 2, a boiler 1 according to this embodiment is formed by using a boiler body 10 having water tube groups arranged in an annular fashion, and a burner 20 (herein after referred to as "first burner 20", which corresponds to the "burner" of the present invention") arranged at the center of those water tube groups. At a position above the first burner 20, there is provided a wind box 40 for supplying combustion air to the first burner 20.

The boiler body 10 has between an upper header 11 and a lower header 12 a plurality of water tube groups (inner water tube group 13 and outer water tube group 14) arranged in an upright state. Water tube groups 13 and 14 are arranged in an annular fashion in substantially concentric circles; the outer water tube group 14 is provided at a predetermined distance from the inner water tube group 13, forming an annular gas flow path 18 between the inner water tube group 13 and the outer water tube group 14. In this embodiment, the portion on the inner side of the water tube groups 13 and 14 arranged in an annular fashion functions as a combustion chamber 16, with the above-mentioned first burner 20 being provided above the combustion chamber 16.

In this embodiment, the inner water tube group 13 is formed in an annular configuration in a state in which inner water tubes 13*a* are in close contact with each other, or in a state in which adjacent inner water tubes 13*a* are connected by inner fin portions 13*b*, with a gas discharge port 17 being provide in a part of the inner water tube group 13. The gas discharge port 17 is open along the longitudinal axes of the water tubes, and functions to guide the gas generated in the combustion chamber 16 on the inner side of the inner water tube group 13 to the annular gas flow path 18.

Further, the outer water tube group 14 is formed in an annular configuration in a state in which the outer water tubes 14*a* are arranged at substantially equal predetermined intervals; between the outer water tubes 14*a*, there are provided outer fin portions 14*b* connecting the outer water tubes 14*a* together so as to eliminate the gaps between the adjacent outer water tubes 14*a*. An outer opening 19 is provided in a part of the outer water tube group 14; the outer opening 19 functions as a discharge portion for discharging a gas that has substantially completed burning reaction to the exterior of the boiler body. That is, the gas produced by the first burner 20 is collected at the outer opening 19, and is then discharged to the exterior of the boiler body 10 through an exhaust cylinder (not shown) provided in the lower portion of the boiler body.

As shown in FIGS. 3 and 4, the first burner 20 included in the boiler 1 of this embodiment is installed in a partition wall 41 in the wind box 40 serving as an air supply device for supplying combustion air to the first burner 20. More specifically, a placement plate 21 constituting the first burner 20 is placed from above on the partition wall 41, and the placement plate 21 is fastened to the partition wall 41 by fastening members (not shown) such as bolts, whereby the first burner 20 is installed in the partition wall 41 within the wind box 40. In this embodiment, the construction of a blower for supplying air to the wind box 40 is omitted since it belongs to the category of a well-known technique.

As shown in FIGS. 3 and 4, the first burner 20 of this embodiment includes nozzle parts 22 (first nozzle part 22*a* and second nozzle part 22*b*) for spraying a liquid fuel, an ignition device 23 provided such that its forward end is situated in the vicinity of a first nozzle part 22*a*, air supply routes (first air supply route 24 for primary air supply and second air supply route 25 for secondary air supply) provided in order to mix the air supplied from the wind box 40 with the liquid fuel sprayed from the nozzle parts 22, a central air jetting part 26 for jetting the air supplied from the first air supply route 24 to the combustion chamber 16 side, and a plurality of peripheral air jetting parts 27 (first peripheral air jetting part 27*a* through sixth peripheral air jetting part 27*f*) jetting the air supplied from the second air supply route 25 to the combustion chamber 16 side. (They correspond to the "air jetting parts" (air jetting parts provided around the nozzle part) of the present invention.)

As the nozzle parts 22 of this embodiment, there are provided the first nozzle part 22*a* for spraying the liquid fuel at the time of low combustion and at the time of high combustion, and a second nozzle part 22*b* for spraying the liquid fuel solely at the time of high combustion. That is, the nozzle parts 22 include the first nozzle part 22*a* placed in the fuel supply state at the time of low combustion (and at the time of high combustion), and the second nozzle part 22*b* placed in the fuel supply state at the time of high combustion together with the first nozzle part 22*a*, with the fuel supply state of the nozzle parts 22 being switched as appropriate according to the boiler combustion load. That is, the nozzle parts 22*a* and 22*b* are on/off-controlled as needed.

The first air supply route 24 constituting the first burner 20 is formed by using a first cylinder member 34 provided on the outer side of the nozzle parts 22, and the second air supply route 25 is formed by using a second cylinder member 35. That is, the region on the inner side of the first cylinder member 34 functions as the first air supply route 24, and the region defined between the first cylinder member 34 and the second cylinder member 35 functions as the second air supply route 25. At the upper end of the second cylinder member 35, there is formed a divergent portion 35A outwardly expanding as it extends upwards. The reason for providing the divergent portion 35A of this configuration is to cause the air supplied from the wind box 40 to flow uniformly in the cross-sectional direction within the second air supply route 25. If the divergent portion 35A are not provided, the air tends to flow while adhering to the inner wall of the second cylinder member 35, which means the air does not flow uniformly in the cross-sectional direction within the second air supply route 25.

At the forward end of the first cylinder member 34 (side end of combustion chamber 16 of boiler 1), there is provided a first air supply plate 36 having the central air jetting part 26. The air supplied from the wind box 40 is jetted to the combustion chamber 16 side through the central air jetting part 26. Further, at the forward end of the second cylinder member 35 (side end of combustion chamber 16 of boiler 1), there is provided a second air supply plate 37 having the plurality of peripheral air jetting parts 27. The air supplied from the wind box 40 is jetted to the combustion chamber 16 side not only through the central air jetting part 26 but also through the plurality of peripheral air jetting parts 27.

As shown in FIGS. 3 and 4, the peripheral air jetting parts 27 (which correspond to "air jetting parts" of the present invention) are provided in the periphery of the nozzle parts 22. The peripheral air jetting parts 27 control the flow of air jetted from the peripheral air jetting parts 27 so as to prevent short-passing of the gas produced by the first burner 20 through the gas discharge port 17 provided in the boiler body 10.

The peripheral air jetting parts 27 of this embodiment include guide portions 38 (first guide portion 38*a* through sixth guide portion 38*f*) guiding at least a part of the air jetted from the peripheral air jetting parts 27 (first peripheral air jetting part 27*a* through sixth peripheral air jetting part 27*f*, respectively) away from the gas discharge port 17, and diffusing portions 39 (first diffusing portion 39*a* through sixth diffusing portion 39*f*) promoting diffusion of the air jetted from the peripheral air jetting parts 27 (first peripheral air jetting part 27*a* through sixth peripheral air jetting part 27*f*, respectively).

More specifically, in this embodiment, the second air supply plate 37 has six substantially trapezoidal through-hole portions 31 (first through-hole portion 31*a* through sixth through-hole portion 31*f*); on the gas discharge port 17 side ("left-hand side" in the embodiment as shown in the drawings) of each of the through-hole portions 31, there are formed the guide portions 38 (first guide portion 38*a* through sixth guide portion 38*f*, respectively) by using plate-like members. The guide portions 38 are formed so as to cover a part of each through-hole portion 31. In this embodiment, the portions not covered with the guide portions 38 function as the diffusing portions 39 (first diffusing portion 39*a* through sixth diffusing portion 39*f*) promoting diffusion of the air jetted from the peripheral air jetting parts 27.

In each guide portion 38, the plate member is inclined (inclined in the direction opposite to gas discharge port 17 (to "right-hand side" in FIG. 3)) in order to guide at least a part of the air jetted from each peripheral air jetting part 27 (mainly air of the region of through-hole portions 31 covered with guide portions 38) away from the gas discharge port 17. The inclination angle θ (mounting angle) preferably ranges from approximately 20° to 60°.

Further, the height of the guide portions 38 is set so as to avoid contact with the liquid fuel sprayed from the nozzle parts 22 in a conical shape (in shape of a three-sided pyramid with nozzle parts 22 at its apex). In this embodiment, the fourth guide portion 38*d* shown on the right-hand side in FIG. 3 is positioned so as to come into contact with the liquid fuel more easily than the first guide portion 38*a* shown on the left-hand side, so the fourth guide portion 38*d* is provided so as to be lower than the first guide portion 38*a*.

As stated above, the diffusing portions 39 (first diffusing portion 39*a* through sixth diffusing portion 39*f*) are the portions of the through-hole portions 31 not covered with the guide portions 38 (encircled regions indicated by dashed lines in FIGS. 3 and 4). In those portions (diffusing portions 39), there are provided no elements for rectifying the flow of the air supplied through the second air supply route 25 like the guide portions 38, so the air jetted from the diffusing portions 39 undergo abrupt expansion.

Thus, in the first burner 20 of this embodiment, the air jetted from the peripheral air jetting parts 27 is guided away from the gas discharge port by the guide portions 38, and at the same time, diffusion of a part of it is promoted by the diffusing portions 39.

The boiler 1 of this embodiment, constructed as described above, provides the following effects. In the following, the effects of this embodiment will be specifically described with reference to FIG. 5 as well as FIGS. 1 through 4. FIG. 5 is a schematic diagram illustrating the gas flow in the boiler body at the time of low combustion. In FIG. 5, the gas flow condition (gas FO) indicated by the chain double-dotted line shows the gas configuration (flame configuration) in a case in which the burner structure differs from that of this embodiment and in which the air from the burner is jetted in a substantially vertical direction. The gas flow condition (gas F1) indicated by the solid line shows the gas configuration (flame configuration) formed by the first burner 20 of this embodiment.

When operating the first burner 20 of this embodiment in a low combustion state, a blower (not shown) is first driven, and air is supplied to the first air supply route 24 and the second air supply route 25 through the wind box 40. Then, in conformity with the timing with which the liquid fuel is sprayed from the first nozzle part 22*a*, electricity is supplied to the ignition device 23.

That is, in this embodiment, air is jetted from the central air jetting part 26 and the peripheral air jetting parts 27 through the first air supply route 24 and the second air supply route 25, and this air is mixed with the liquid fuel sprayed from the first nozzle part 22*a*. Then, the liquid fuel mixed with the air is ignited by the ignition device 23 provided in the vicinity of the first nozzle part 22*a* and generating an electric spark through supply of electricity. Through this ignition, the liquid fuel sprayed from the first nozzle part 22*a* is burnt, and the low combustion state is maintained as long as the liquid fuel continues to be sprayed from the first nozzle part 22*a*. When the liquid fuel is supplied not only from the first nozzle part 22*a* but also from the second nozzle part 22*b*, the first burner 20 attains a high combustion state.

In the first burner 20 of this embodiment, by switching the fuel supply state in the nozzle parts 22 as appropriate (under on/off control), it is possible to effect switching between stop, low combustion, and high combustion. That is, when the combustion state is continued, switching is possible from low combustion to high combustion or from high combustion to low combustion.

The amount of air supplied to the first burner 20 is generally adjusted by using a damper (not shown) provided in a duct between the wind box 40 and the blower, an inverter (not shown) for controlling the RPM of the blower, etc. This air is supplied in correspondence with the supply amount of the liquid fuel. For example, in a burner formed by using two nozzle tips of the same fuel supply performance, assuming that the amount of air supplied when liquid fuel is sprayed from one of the nozzle tips (at the time of low combustion) is "1", the amount of air supplied when the liquid fuel is sprayed from both nozzle tips (at the time of high combustion) is "2". Such adjustment of the air amount is conducted by using the damper, the inverter, etc.

As shown in FIG. 5, in the boiler 1, constructed and functioning as described above, at the time of low combustion of the first burner 20, there is formed a gas F1 (indicated by the solid line) which is expanded uniformly within the boiler body 10 substantially around the central portion of the combustion chamber 16. The gas F1 of this configuration is formed because the air jetted from the peripheral air jetting parts 27 can be controlled so as to avoid short-passing of the gas produced by the first burner 20 through the gas discharge port 17 provided in the boiler body 10. More specifically, as described above, this is because each peripheral air jetting part 27 has the guide portion 38 guiding at least a part of the air away from the gas discharge port 17.

If the guide portions 38 of this embodiment are not provided, the gas produced by the burner will be drawn toward the gas discharge port 17, with the result that the gas formed in the boiler body 10 is a gas F0 indicated by the dashed line in FIG. 5. That is, in conventionally known burners, there are provided no guide portions 38 of this embodiment, so it is to be assumed that the gas F0 of the above-mentioned configuration is formed within the boiler body. In this case, the gas is drawn toward the gas discharge port within the boiler body, so the gas cannot expand to a sufficient degree within the combustion chamber, which leads to various problems. For example, the exhaust gas circulation flow within the combustion chamber will be obstructed.

In contrast, in this embodiment, due to the provision of the guide portions 38 as described above, it is possible to form the gas F1 uniformly expanded within the combustion chamber 16. Thus, this embodiment provides the following effects.

First, in this embodiment, the gas F1 is prevented from short-passing through the gas discharge port 17 (i.e., it is not drawn toward the gas discharge port), so the gas F1 (inclusive of flame) produced by the first burner 20 can be expanded to a sufficient degree within the combustion chamber 16 in the boiler body 10. That is, due to the expansion of the gas F1, the gas temperature is lowered, so it is possible to reduce the NOx value.

Further, in this embodiment, the gas F1 is not drawn toward the gas discharge port 17, so the exhaust gas circulation flow is formed in a proper manner within the boiler body 10. Then, due to the exhaust gas circulation flow (self EGR) within the boiler body 10, the gas temperature is lowered, making it possible to reduce the NOx value.

Further, in this embodiment, the plurality of peripheral air jetting parts 27 are provided around the nozzle parts 22, and air is supplied therefrom in a divided state, so a split flame is formed at the first burner 20. A technique for forming a split flame has conventionally been known; however, as described above, in the prior-art technique, the gas is drawn to the gas discharge port side, so it is to be assumed that no proper split flame can be formed. In this embodiment, in contrast, the air from the peripheral air jetting parts 27 is jetted while inclined in a direction opposite to the gas discharge port 17, so the gas F1 is not drawn to the gas discharge port 17 side, and a proper split flame is formed at the first burner 20. When such an appropriate split flame is formed, the surface area of the gas F1 increases, so it is possible to achieve a reduction in NOx value.

Further, the peripheral air jetting parts 27 constituting the first burner 20 of this embodiment has the diffusing portions 39 as well as the guide portions 38 providing the various effects as mentioned above. As described above, the diffusing portions 39 are the portions of the through-hole portions 31 not covered with the guide portions 38 (see FIGS. 3 and 4). That is, the diffusing portions 39 are provided with no elements for rectifying the air flow like the guide portions 38, so the air jetted from the diffusing portions 39 undergoes abrupt expansion at the edge portions of the diffusing portions 39 (edge portions of through-hole portions 31). Then, in the immediate vicinity of the first burner 20, a little disturbance is generated in the air, making it possible to make partially uneven the way the liquid fuel sprayed from the nozzle parts 22 is mixed with the air. Due to the provision of the diffusing portions 39, the first burner 20 of this embodiment does not simply make the mixing condition satisfactory, but can intentionally attain a partially uneven mixing state. That is, in this embodiment, due to the provision of the diffusing portions 39, it is possible to attain a combustion state like a thick and thin combustion state in the vicinity of the first burner 20, so it is possible to lower the gas temperature and to achieve a reduction in NOx value.

As described above, in the boiler 1 of this embodiment, it is possible to achieve a reduction in NOx due to the synergistic effect of the reduction in the gas temperature due to the sufficient expansion of the gas F1 within the combustion chamber 16 of the boiler body 10, the reduction in the gas temperature due to the proper exhaust gas circulation flow formed within the boiler body 10, the reduction in the gas temperature due to the formation of a proper split flame, and the reduction in the gas temperature due to the thick and thin combustion attained by the diffusing portions 39.

The present invention is not restricted to the above-mentioned embodiment; the present invention allows various modifications as needed without departing from the gist of the invention, and all such modifications are covered by the technical scope of the present invention.

Figure 6:
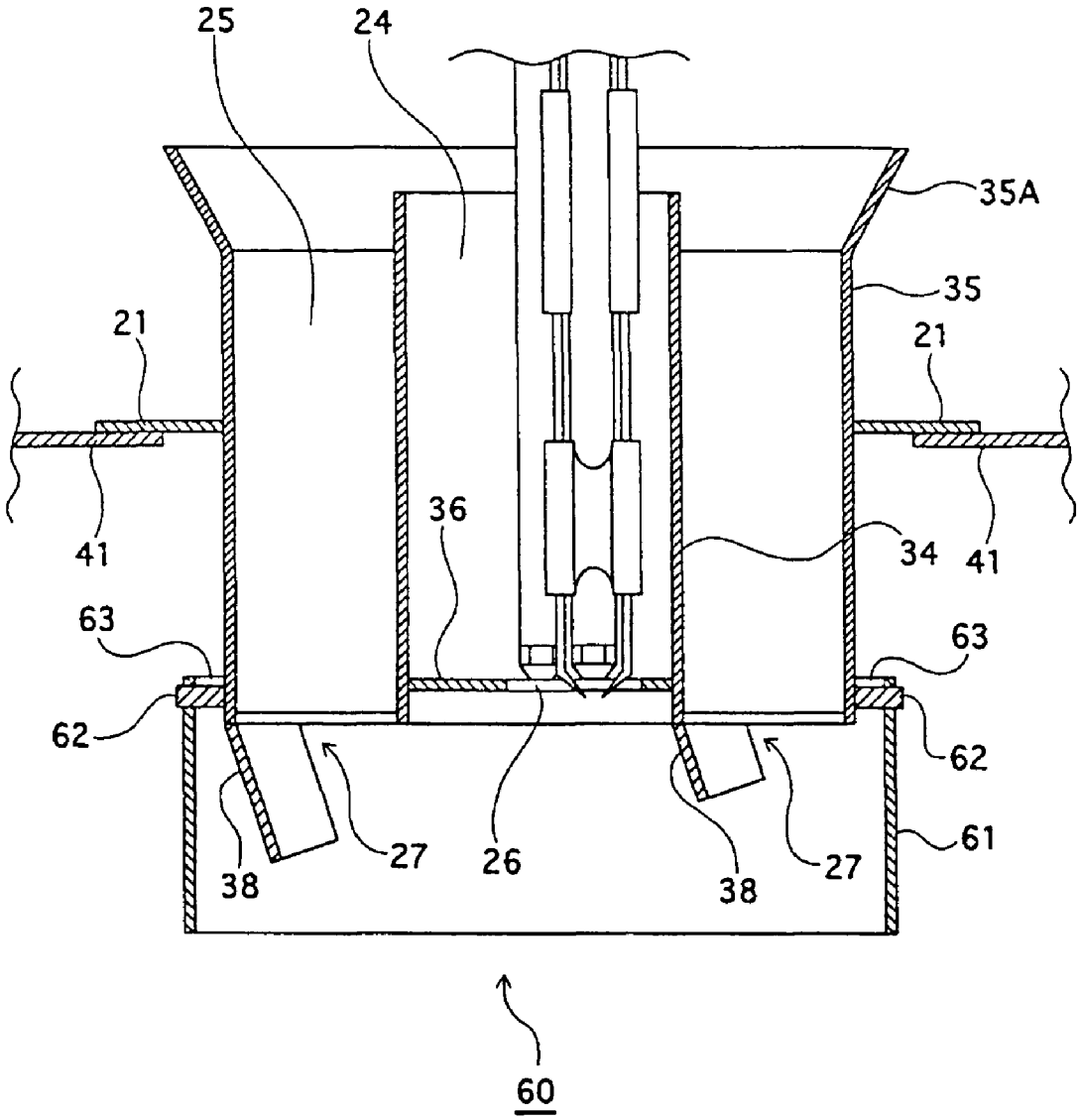
FIG. 6 is an explanatory longitudinal sectional view of a second burner (burner) according to another embodiment of the present invention.
Figure 7:
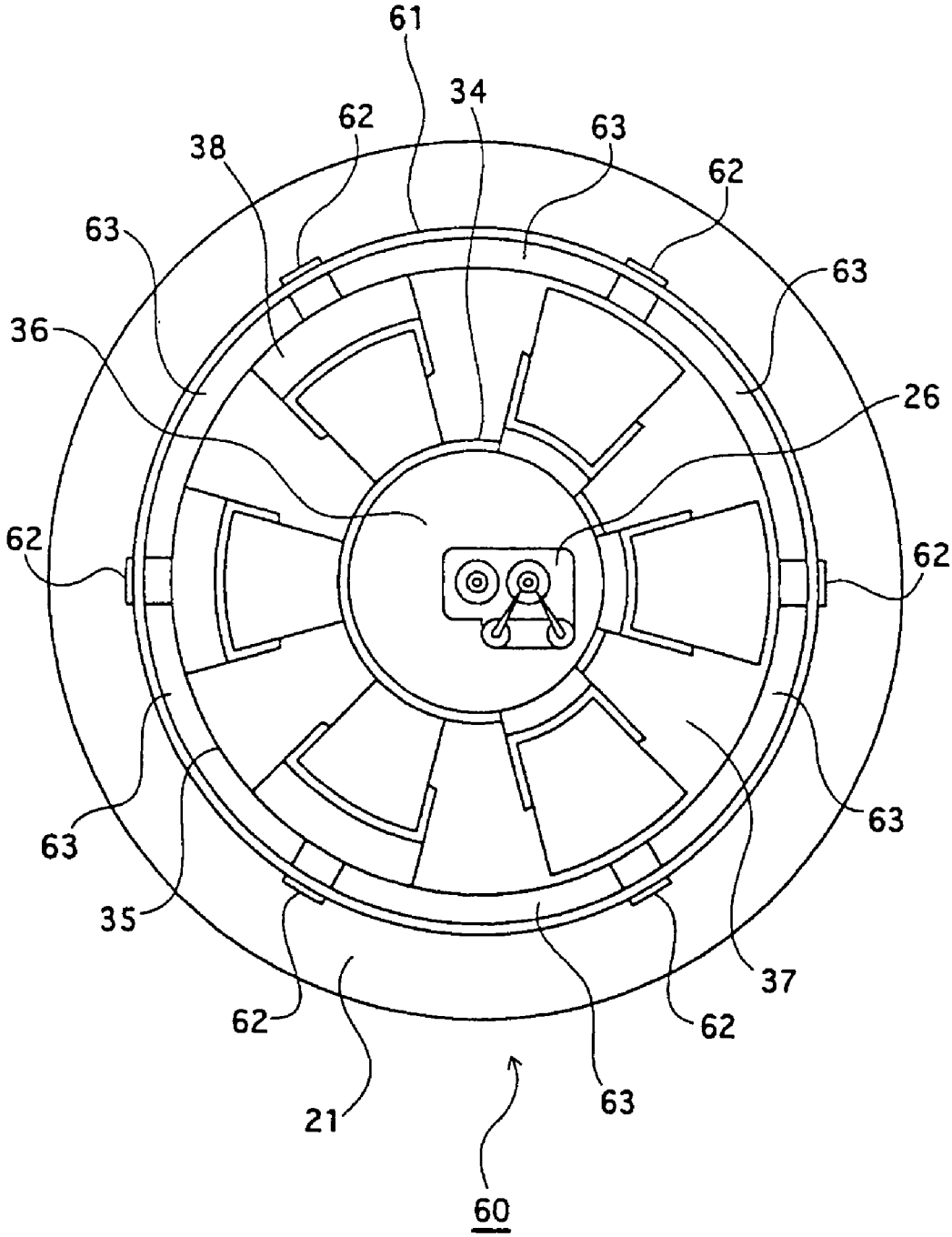
FIG. 7 is a bottom view of the second burner (burner) shown in FIG. 6.

For example, the burner of the present invention is not restricted to the first burner 20 as described with reference to FIGS. 1 through 5; it is also possible to adopt, as needed, a construction as shown in FIGS. 6 and 7. In this case, FIG. 6 is an explanatory longitudinal sectional view of a burner 60 according to another embodiment of the present invention (herein after referred to as "second burner 60") (which corresponds to the "burner" of the present invention). FIG. 7 is a bottom view of the second burner 60 shown in FIG. 6. The second burner 60 shown in FIGS. 6 and 7 basically has the same construction as that of the first burner 20 described with reference to FIGS. 3, 4, etc., so the components common to those burners are indicated by the same reference numerals, and a description thereof will be omitted; the following description will center on the features of the second burner 60 of this embodiment.

The second burner 60 shown in FIGS. 6 and 7 differs from the above-mentioned first burner 20 (see FIG. 3, etc.) in the presence of a combustion cylinder 61. That is, the second burner 60 of this embodiment differs from the first burner 20 of the above-mentioned embodiment in that it has the combustion cylinder 61 on the outer side of the second air supply route 25 constituting the peripheral air jetting parts 27.

The combustion cylinder 61 is provided on the outer side of the second cylinder member 35 by using connection members 62 such as bolts; a predetermined space (circulation portion 63 described below) is provided between the second cylinder member 35 and the combustion cylinder 61. In this embodiment, the combustion cylinder 61 is fixed in position on the outer side of the second cylinder member 35 by using six connection members 62 provided at equal intervals.

In the second burner 60, constructed as shown in FIGS. 6 and 7, the exhaust gas circulating within the boiler body 10 enters the combustion cylinder 61 through a circulation portion 63, whereby it is also possible to achieve a reduction in NOx value. Further, due to the provision of the combustion cylinder 61, it is possible to suppress expansion of the gas to promote the combustion in the vicinity of the second burner 60, so it is possible to suppress arise in CO on the low $O_2$ side (where the residual oxygen concentration in the exhaust gas is approximately 2% to 3%). However, those effects vary depending upon various conditions such as the air jetting state at the burner, the combustion amount of the boiler, the gas configuration in the boiler body 10, and the arrangement of the water tubes constituting the boiler body 10; thus, it is necessary to decide whether to provide the combustion cylinder 61 or not according to those conditions.

While in the example shown in FIGS. 6 and 7 the combustion cylinder 61 is provided upright, the present invention is not restricted to this construction. Thus, it is also possible, for example, for the combustion cylinder itself to be inclined like the guide portions 38.

Further, while in the above-mentioned embodiments the guide portions 38 provided at the peripheral air jetting parts 27 are inclined in the same direction and at the same angle, this should not be construed restrictively. Thus, it is also possible, for example, to install the guide portions 38 at different angles as appropriate.

Further, while in the above-mentioned embodiments the guide portions 38 are formed by using plate-like members of a U-shaped sectional configuration (shovel-type members), this should not be construed restrictively; any construction will do as long as the guide portions 38 make it possible to guide at least a part of the air jetted from the peripheral air jetting parts 27 away from the gas discharge port 17. Thus, it is also possible, for example, to form the guide portion by using a single flat plate-like member. More specifically, it is also possible to provide an inclined flat plate-like member at the "one side" closest to the gas discharge port 17 of each through-hole portion 31 constituting the peripheral air jetting part 27. Also in this construction, it is possible to guide at least a part of the air jetted from the peripheral air jetting parts 27 away from the gas discharge port 17, so it is possible to attain the various effects as mentioned above.

Further, while in the above-mentioned embodiments the second nozzle 22*b* for high combustion is arranged in the central axis of the first cylinder member 34, and the first nozzle 22*a* for low combustion (and high combustion) is arranged away from the gas discharge port 17 with respect to the above-mentioned central axis, this should not be construed restrictively. For example, it is also possible to arrange the components such that the center between the second nozzle 22*b* and the first nozzle 22*a* overlaps the central axis of the first cylinder member 34. Further, the present invention is also applicable to a burner which supplies fuel with a single nozzle (not shown), switching between low combustion amount and high combustion amount.

Further, while in the above-mentioned embodiments (embodiments described with reference to FIGS. 1 through 7) all the peripheral air jetting parts 27 are equipped with the guide portions 38, the present invention is not restricted to this construction. The present invention aims to control the flow of air (combustion air) so as to avoid short-passing of the gas produced by the burner through the gas discharge port 17 provided in the gas. As a result, apart from the construction in which all the peripheral air jetting parts are equipped with guide portions, the present invention also covers a construction in which a part of the peripheral air jetting parts is provided with guide portions.

Figure 8:
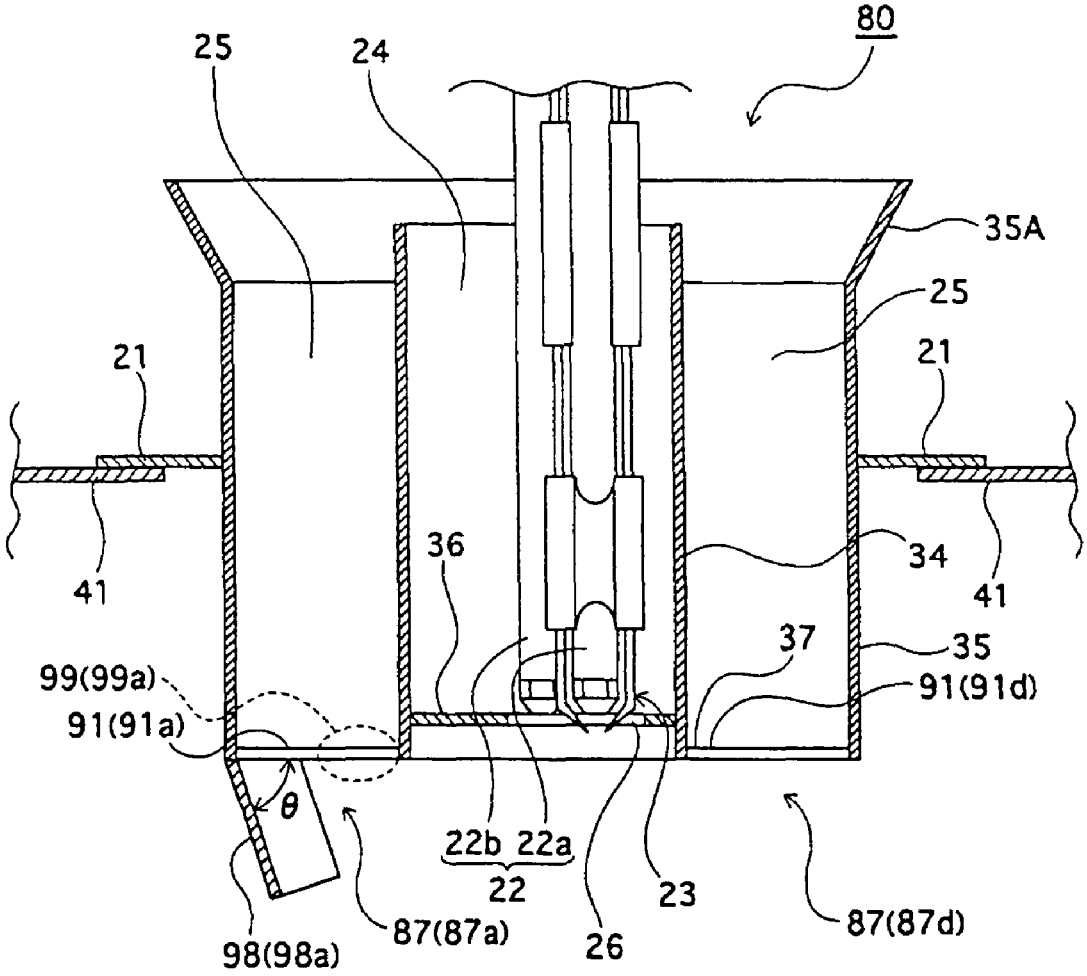
FIG. 8 is an explanatory longitudinal sectional view of a third burner (burner) according to another embodiment of the present invention.
Figure 9:
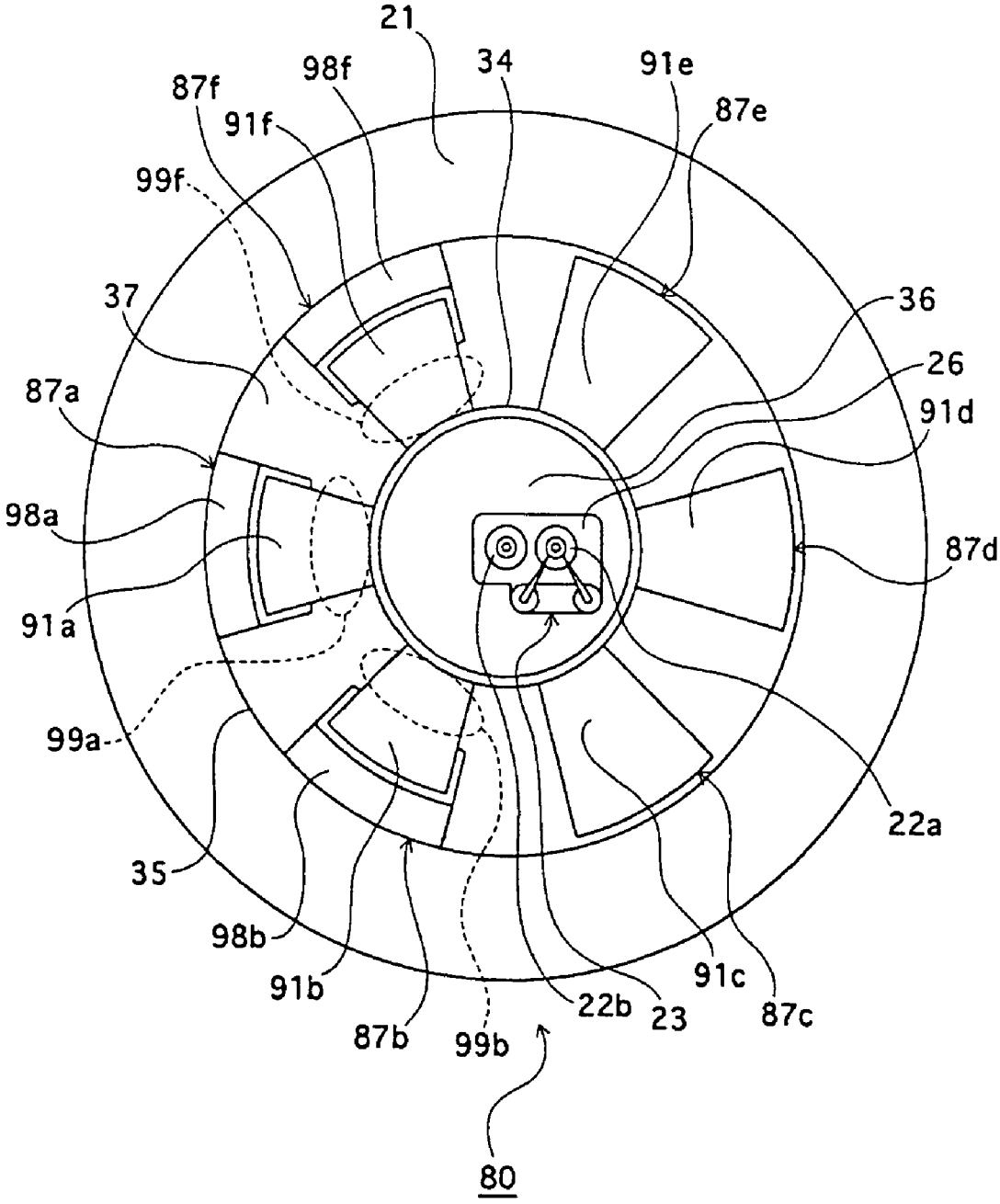
FIG. 9 is a bottom view of the third burner (burner) shown in FIG. 8.

Thus, it is possible, for example, to adopt, as a burner according to another embodiment of the present invention, a construction as shown in FIGS. 8 and 9. In this case, FIG. 8 is an explanatory longitudinal sectional view of a burner 80 (herein after referred to as "third burner 80") (which corresponds to the "burner" of the present invention), and FIG. 9 is a bottom view of the third burner 80 shown in FIG. 8. The third burner 80 shown in FIGS. 8 and 9 has basically the same construction as the first burner 20 described with reference to FIGS. 3, 4, etc. For this reason, of the components of the third burner 80, those which are the same as those of the first burner 20 are indicated by the same reference numerals, and a description thereof will be omitted; the following description will center on the features of the third burner 80.

The difference between the above-mentioned first burner 20 (see FIG. 3, etc.) and the third burner shown in FIGS. 8 and 9 lies in the construction of peripheral air jetting parts 87 (which correspond to "air jetting parts" of the present invention) provided around the nozzle parts 22. That is, the construction of the third burner 80 of this embodiment differs from that of the first burner 20 of the above-mentioned embodiment in that a part of six peripheral air jetting parts 87*a* through 87*f* have a different structure.

More specifically, unlike in the first burner 20, in the third burner 80 shown in FIGS. 8 and 9, of the six peripheral air jetting parts 87 provided around the nozzle parts 22, the first peripheral air jetting part 87*a*, the second peripheral air jetting part 87*b*, and the sixth peripheral air jetting part 87*f* have guide portions 98 (first guide portion 98*a*, second guide portion 98*b*, and sixth guide portion 98*f*, respectively), and the other peripheral air jetting parts, that is, the third peripheral air jetting part 87*c*, the fourth peripheral air jetting part 87*d*, and the fifth peripheral air jetting part 87*e* have no guide portions.

That is, as in the first burner 20, in the first peripheral air jetting part 87*a*, the second peripheral air jetting part 87*b*, and the sixth peripheral air jetting part 87*f*, the guide portions 98 (first guide portion 98*a*, second guide portion 98*b*, and sixth guide portion 98*f*) are formed by using plate-like members on the gas discharge port 17 side ("left-hand side" in the embodiment as shown in the drawings) of each of the through-hole portions 91 (first through-hole portion 91*a*, second through-hole portion 91*b*, and sixth through-hole portion 91*f*, respectively) formed in the second air supply plate 37, and the portions not covered with the guide portions 98 function as diffusing portions 99 (first diffusing portion 99*a*, second diffusing portion 99*b*, and sixth diffusing portion 99*f*) promoting diffusion of the air jetted from the peripheral air jetting parts 87*a*, 87*b*, and 87*f*, respectively.

The third peripheral air jetting part 87*c*, the fourth peripheral air jetting part 87*d*, and the fifth peripheral air jetting part 87*e* have no guide portions, and the through-hole portions 91 (third through-hole portion 91*c*, fourth through-hole portion 91*d*, and fifth through-hole portion 91*e*) are simply formed in the second air supply plate 37.

In the third burner 80 of this embodiment, constructed as described above, the combustion air jetted from the first peripheral air jetting part 87*a*, the second peripheral air jetting part 87*b*, and the sixth peripheral air jetting part 87*f* is controlled by the guide portions 98 (first guide portion 98*a*, second guide portion 98*b*, and sixth guide portion 98*f*, respectively) so as to flow to the side opposite to the gas discharge port 17. With this controlled flow of combustion air, the combustion air from the third peripheral air jetting part 87*c*, the fourth air jetting part 87*d*, and the fifth peripheral air jetting part 87*e* having no guide portions is also jetted while inclined in the direction opposite to the gas discharge port 17.

That is, in this embodiment, although a part of the peripheral air jetting parts 87 have no guide portions 98, the flow of combustion air jetted from the third burner 80 is controlled as described above. Thus, as in the other embodiments described above, in this embodiment, the gas produced by the third burner 80 does not short-pass through the discharge port 17 provided in the boiler body, making it possible for the gas (inclusive of flame) produced by the third burner 80 to expand to a sufficient degree within the combustion chamber 16 of the boiler body 10. If it is possible to thus expand the gas to a sufficient degree, the gas temperature is lowered, so it is possible to achieve a reduction in NOx value.

As in the other embodiments, in this embodiment also, the gas is not drawn to the gas discharge port 17 side, so the exhaust gas circulation flow within the boiler body 10 is formed in an appropriate manner. Then, due to the exhaust gas circulation flow (self EGR) within the boiler body 10, the gas temperature is lowered, and it is possible to achieve a reduction in NOx value.

Further, as in the other embodiments described above, in this embodiment also, it is possible to obtain various effects (inclusive of synergistic effects) such as a NOx value reduction effect due to the formation of a split flame, and a satisfactory mixing effect due to the provision of the diffusing portions 99.

Further, as shown in FIGS. 8 and 9, in this embodiment, the third peripheral air jetting part 87*c*, the fourth peripheral air jetting part 87*d*, and the fifth peripheral air jetting part 87*e* constituting the third burner 80 are equipped with no guide portions 98. That is, in the third burner 80 of this embodiment, no guide portions 98 are provided at the peripheral air jetting parts 87*c*, 87*d*, and 87*e* situated on the side to which the gas flow formed under control of the flow of combustion air comes close (side opposite to gas discharge port 17).

In this construction, unlike the other peripheral air jetting parts 87*a*, 87*b*, and 87*f*, the third peripheral air jetting part 87*c*, the fourth peripheral air jetting part 87*d*, and the fifth peripheral air jetting part 87*e* are equipped with no guide portions 98 protruding toward the combustion chamber 16 from the second air supply plate 37, so even if the gas approaches those peripheral air jetting parts 87*c*, 87*d*, and 87*e*, the forward end portion of the third burner 80 is not liable to be thermally affected. That is, in this embodiment, no guide portions 98 are provided on the side close to the gas, and the third burner 80 as a whole is not easily thermally affected, whereby it is possible to achieve an improvement in terms of the durability of the burner.

Further, while in the above-mentioned embodiments the kind of liquid fuel used is not specified, the present invention is not restricted to some specific liquid fuel. The present invention is applicable to liquid fuels such as kerosene, A-type heavy oil, B-type heavy oil, and C-type heavy oil.

What is claimed is:

1. A boiler, comprising:

a plurality of water tubes forming a boiler body;

a burner having a nozzle part configured to spray a liquid fuel into a combustion chamber in the boiler body;

a discharge port provided at a first radial position in the boiler body and configured to receive gas created by combustion of the liquid fuel; and an air jetting part provided around the nozzle part, the air jetting part including a first plate substantially surrounding the nozzle, at least one hole formed in the first plate enabling a flow of air through the first plate, and a guide portion formed adjacent to the at least one hole and partially obstructing a straight path of the air flowing through the hole and bending the straight path away from the first radial position of the discharge port.

2. A boiler according to claim 1, wherein the guide portion includes:

a plate-shaped member provided at a position on the first plate of the air jetting part corresponding to the first radial position of the discharge port.

3. A boiler according to claim 1, wherein a height of the guide portion in a direction parallel to the water tubes is set so that the guide portion is prevented from coming into contact with the liquid fuel sprayed from the nozzle part.

4. The boiler according to claim 3, wherein the air jetting part includes:

a plurality of holes formed in the first plate;

a plurality of guide portions adjacent and corresponding to the plurality of holes, wherein the height of a guide portion closest to the nozzle part is smaller than the height of a guide portion farthest from the nozzle part.

5. A boiler according to claim 1, wherein the gas discharge port provided in the boiler body is open along longitudinal axes of the water tubes.

6. The boiler according to claim 1, wherein the guide portion is inclined relative to the first plate at an angle from approximately 20 degrees to approximately 60 degrees.

7. The boiler according to claim 1, wherein the first plate has a substantially circular shape and includes a circular hole in its center accommodating the nozzle part, the circular hole defining an inner edge of the first plate, and the at least one hole is substantially trapezoidal in shape having a first side adjacent to the inner edge of the first plate, and a second side adjacent to an outer edge of the first plate.

8. The boiler according to claim 7, wherein the guide portion is physically joined to the second side of the at least one hole and does not contact the first side.

9. The boiler according to claim 7, wherein the guide portion is physically joined to the first side of the at least one hole and does not contact the second side.

10. The boiler according to claim 1, wherein the guide portion is formed of plate-like members and has a substantially U-shaped cross sectional shape.

11. The boiler according to claim 10, wherein the guide portion includes three plates joined adjacent to each other forming a substantially U-shaped cross sectional shape.

12. The boiler according to claim 11, wherein the first plate has a substantially circular shape and includes a circular hole in the center accommodating the nozzle part, the circular hole defining an inner edge of the first plate, the at least one hole is substantially trapezoidal in shape having a first side adjacent to the inner edge of the first plate, and a second side adjacent to an outer edge of the first plate, a middle plate of the three plates is attached adjacent to the entire second side, and the remaining two plates of the three plates are attached to a subsection of a third side and a subsection of a fourth side of the at least one hole, respectively.

13. The boiler according to claim 11, wherein the first plate has a substantially circular shape and includes a circular hole in the center accommodating the nozzle part, the circular hole defining an inner edge of the first plate, the at least one hole is substantially trapezoidal in shape having a first side adjacent to the inner edge of the first plate, and a second side adjacent to an outer edge of the first plate, a middle plate of the three plates is attached adjacent to the entire first side, and the remaining two plates of the three plates are attached to a subsection of a third side and a subsection of a fourth side of the at least one hole, respectively.

14. The boiler according to claim 1, wherein the guide portion is formed of a single flat plate-like member.

15. The boiler according to claim 14, wherein the guide portion is inclined in a direction toward the center of the first plate.

16. The boiler according to claim 14, wherein the guide portion is inclined in a direction away from the center of the first plate.

17. The boiler according to claim 1, wherein the air jetting part includes a first number of holes formed in the first plate, and a second number smaller than the first number, of guide portions formed adjacent to some of the holes.

18. The boiler according to claim 17, wherein the air jetting part includes six holes formed in the first plate, and three guide portions each formed adjacent to three of the six holes.

19. The boiler according to claim 1, further comprising:

a combustion cylinder surrounding the first plate, the combustion cylinder including a cylindrical body and an air inlet portion configured to supply air into the boiler through a space formed between an outer edge of the first plate and the cylindrical body of the combustion cylinder.

20. The boiler according to claim 19, wherein the central axis of the cylindrical body of the combustion cylinder is oriented in a radial direction away from the first radial position of the discharge port.

* * * * *